US009341019B2

(12) United States Patent
Chen

(10) Patent No.: US 9,341,019 B2
(45) Date of Patent: May 17, 2016

(54) CONTROLLING MECHANISM FOR CORDLESS BLIND SET

(71) Applicant: Chin-Fu Chen, Taichung (TW)

(72) Inventor: Po-Yu Chen, Taichung (TW)

(73) Assignee: Chin-Fu Chen, Taichung (TW)

( * ) Notice: Subject to any disclaimer, the term of this patent is extended or adjusted under 35 U.S.C. 154(b) by 0 days.

(21) Appl. No.: 14/227,105

(22) Filed: Mar. 27, 2014

(65) Prior Publication Data

US 2015/0176329 A1 Jun. 25, 2015

(30) Foreign Application Priority Data

Dec. 20, 2013 (TW) ..... 102147603 A

(51) Int. Cl.
*E06B 9/322* (2006.01)
*E06B 9/325* (2006.01)
*E06B 9/388* (2006.01)

(52) U.S. Cl.
CPC ..... *E06B 9/322* (2013.01); *E06B 9/325* (2013.01); *E06B 9/388* (2013.01); *E06B 2009/3222* (2013.01)

(58) Field of Classification Search
CPC ..... Y10T 24/3993; E06B 9/324; E06B 9/322; E06B 9/388; E06B 9/325; E06B 2009/3222
USPC ..... 160/170, 171, 178.2, 168.1 R, 178.1 R, 160/84.04, 84.05; 24/136 A, 115 M, 115 G
See application file for complete search history.

(56) References Cited

U.S. PATENT DOCUMENTS

| | | | | |
|---|---|---|---|---|
| 5,472,036 | A * | 12/1995 | Judkins | 160/178.2 |
| 7,337,503 | B1 * | 3/2008 | Ashbrook | 24/115 G |
| 7,690,415 | B2 * | 4/2010 | Cheng | 160/178.2 |
| 2002/0088562 | A1 * | 7/2002 | Palmer | 160/170 |
| 2004/0007333 | A1 * | 1/2004 | Militello et al. | 160/84.04 |

* cited by examiner

*Primary Examiner* — Blair M Johnson
(74) *Attorney, Agent, or Firm* — Muncy, Geissler, Olds & Lowe, P.C.

(57) ABSTRACT

A controlling mechanism for a cordless blind set includes a fastening seat, a controlling member, and two driving gears. A coil spring is between the two driving gears each engaged with a driven gear. Each of the driven gears is coupled with a transmission rope passing through the fastening seat and the controlling member and then gets fixed in an upper beam. To operate the blind set, a pushing force is applied to the controlling member to release the transmission ropes. The driving gears are then driven by the coil spring and rotate the driven gears simultaneously, so the driven gears can roll up/release the transmission ropes.

5 Claims, 17 Drawing Sheets

CONTROLLING MECHANISM FOR CORDLESS BLIND SET

BACKGROUND OF THE INVENTION

1. Technical Field

The present invention relates to blinds foe windows, and more particularly to a controlling mechanism for a cordless blind set.

2. Description of Related Art

Blinds for windows can be roughly classified as those using cords for operation and cordless ones. For those using cords, the blind body is lowered and raised by operating a rope. This kind of blinds is nevertheless disadvantageous for increased operational effort and poor positioning effect. What is more serious is that the exposed rope can be dangerous to young children playing there around as it may be accidently wound around a child's neck and cause asphyxia. On the other hand, a cordless blind set works upon a user's upward or downward pulling force that acts on the lower beam of the blind set to drive the a controlling mechanism to lower or raise the blind body. However, the existing controlling mechanisms for cordless blinds are structurally complex, and have its transmission effect needing to be improved.

SUMMARY OF THE INVENTION

The primary objective of the present invention is to provide a controlling mechanism for a cordless blind set, wherein the controlling mechanism is easy to use and provides good transmission effect, while ensuring use safety.

For achieving the foregoing objective, the disclosed controlling mechanism comprises two controlling assemblies, a gear assembly, and two transmission ropes. Each said controlling assembly has a fastening seat, a controlling member, and a returning elastic member. The fastening seat is fixed in a lower beam and has a first rope hole, a second rope hole opposite to the first rope hole, and an accommodating socket communicated with the first and second rope holes. The controlling member is movably received in the accommodating socket of the fastening seat and has a rope channel. The returning elastic member is provided between the fastening seat and the controlling member, for providing a returning force to the controlling member. The gear assembly is located between the two controlling assemblies and has a gear seat, two driving gears, two driven gears, and a coil spring. The gear seat is fixed in the lower beam. The two driving gears are rotatably installed in the gear seat and are engaged with each other. The two driven gears are rotatably installed in the gear seat and each engaged with one said driving gear. The coil spring is connected between the two driving gears and selectably wound around one of the two driving gear. Each said transmission rope passes through the first and second rope holes of one said fastening seat and the rope channel of one said controlling member. Each said transmission rope has its two opposite ends fixed in an upper beam and to one said driven gear, respectively.

With the aforementioned configuration, when it is desired to lower or raise a blind body formed between the upper and lower beams, a user can first applies a force to the controlling member, so as to force the controlling member to be at a released position. At this time, interference between the controlling member and the transmission rope is eliminated. Then the two driving gears can be driven by the resilient force of the coil spring to rotate the two driven gears, making each said driven gear rotate and roll up/release the transmission rope connected thereto. Once the force acting on the controlling member is removed, the controlling member moves to a retained position, where the controlling member and the transmission ropes come into mutual interference. As a result, each said transmission rope is prevented from being rolled up/released by the driven gear anymore, and the blind body is positioned.

Preferably, the inner side of the peripheral wall of each said fastening seat has a retaining notch. The controlling member has a trunk extending into the accommodating socket. The trunk at its outer peripheral surface has a retaining salient for being inlaid into the retaining notch. Thereby, the controlling member is prevented from leaving the accommodating socket.

Preferably, each said driving gear has a first spacing ring mounted around its middle height, so that each said driving gear is divided by the first spacing ring into an upper half and a lower half. The upper halves of the two driving gear are connected by one said coil spring, and the lower halves of the two driving gear are connected by the other said coil spring, so that force driving the two driving gear can be increased.

Preferably, each said driven gear has a second spacing ring, mounted around its middle height, so that each driven gear is divided by the second spacing ring into an upper half and a lower half. The upper halves of the two driven gears are each connected to one said transmission rope, and the lower halves of the two driven gears are each connected to the other said transmission rope, so that the blind body when being lowered and raised can remain balanced and stable.

DETAILED DESCRIPTION OF THE INVENTION

Figure 1:
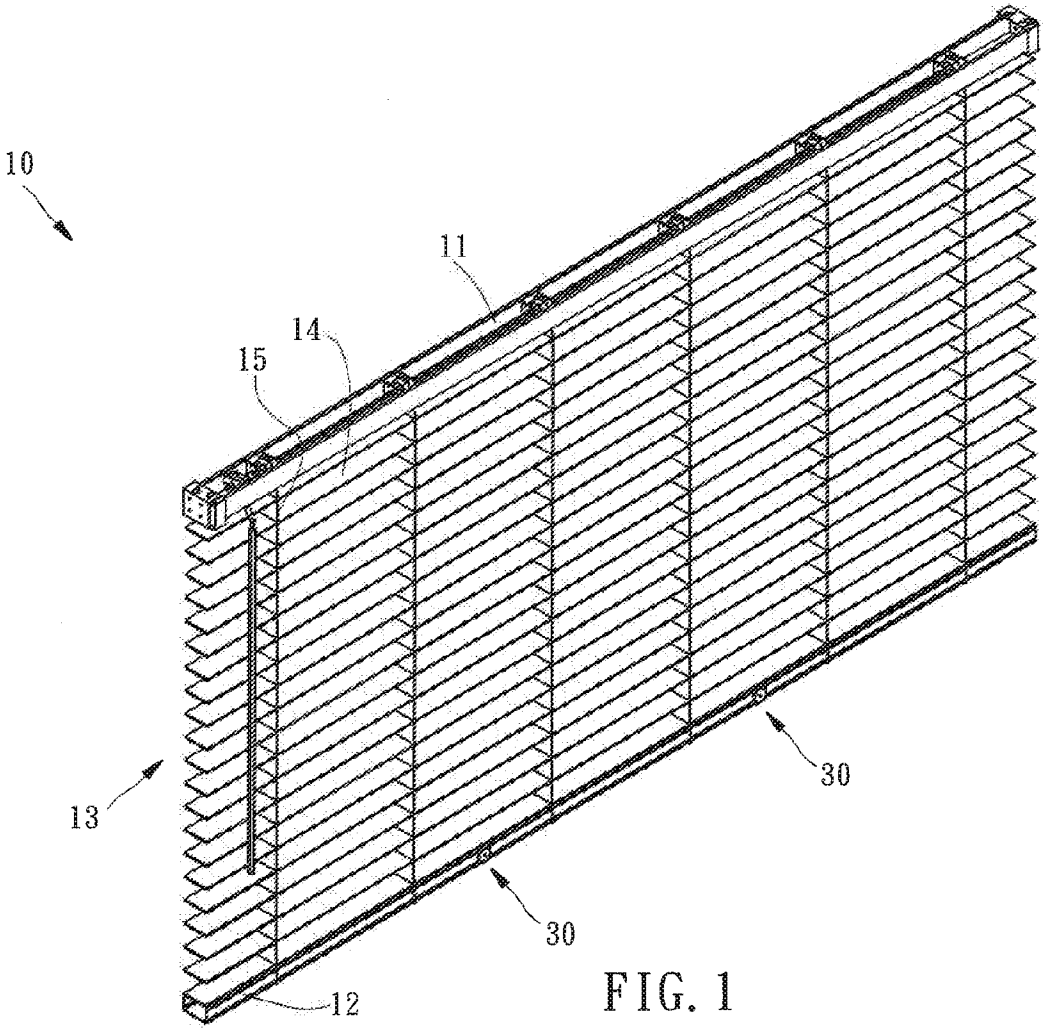
FIG. 1 is a perspective view of a cordless blind set with a first embodiment of the present invention, showing the blind body lowered.
Figure 2:
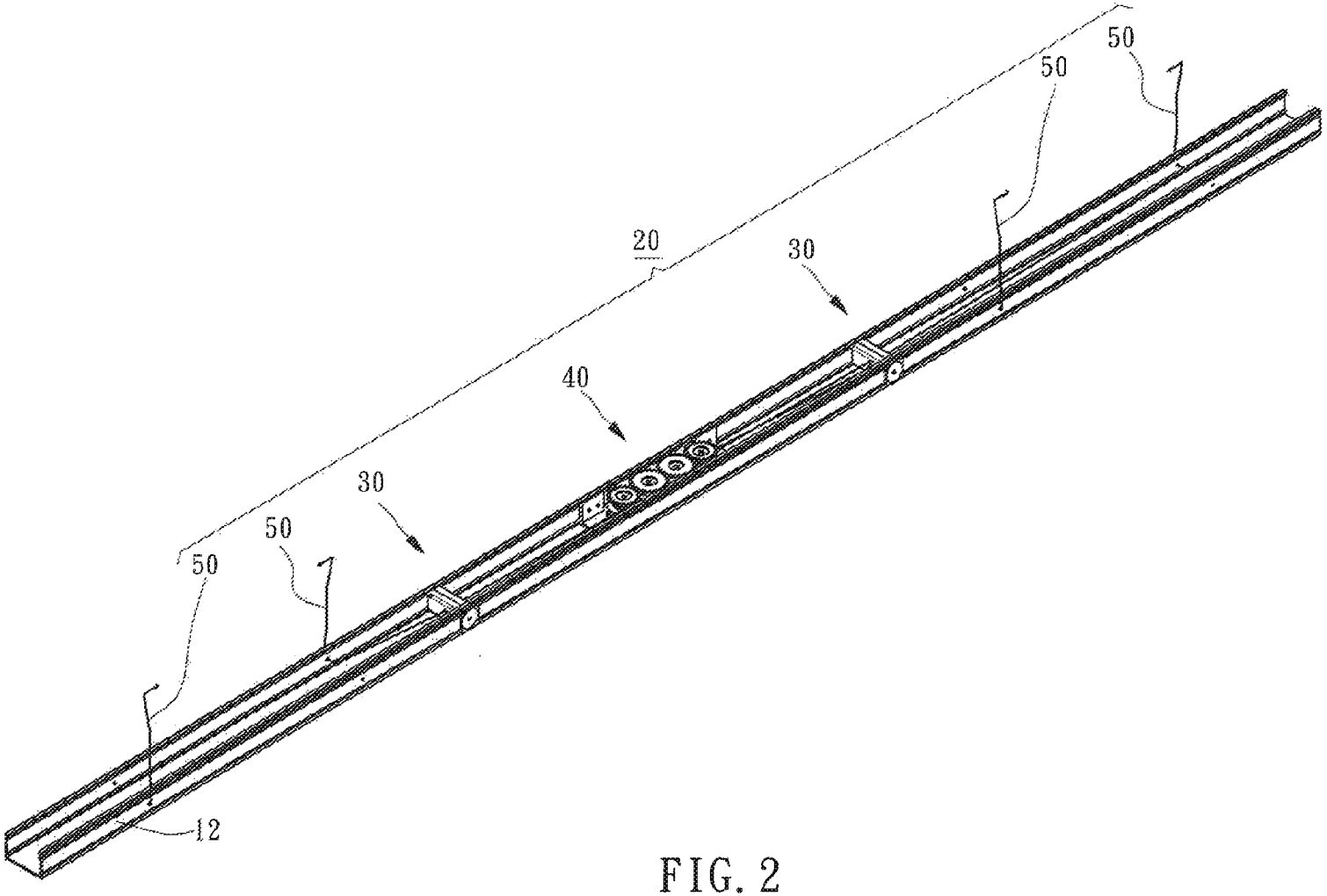
FIG. 2 is a perspective view of the first embodiment of the present invention.

Referring to FIG. 1, as shown, a cordless blind set 10 comprises an upper beam 11, a lower beam 12 opposite to the upper beam 11, and a blind body 13 formed between the upper and lower beams 11, 12. The blind body 13 is made by connecting plural blades 14 and plural ladder cords 15. Referring now to FIG. 2, in a first embodiment of the present invention, a controlling mechanism 20 comprises two controlling assemblies 30, a gear assembly 40, and two pairs of transmission ropes 50.

Figure 3:
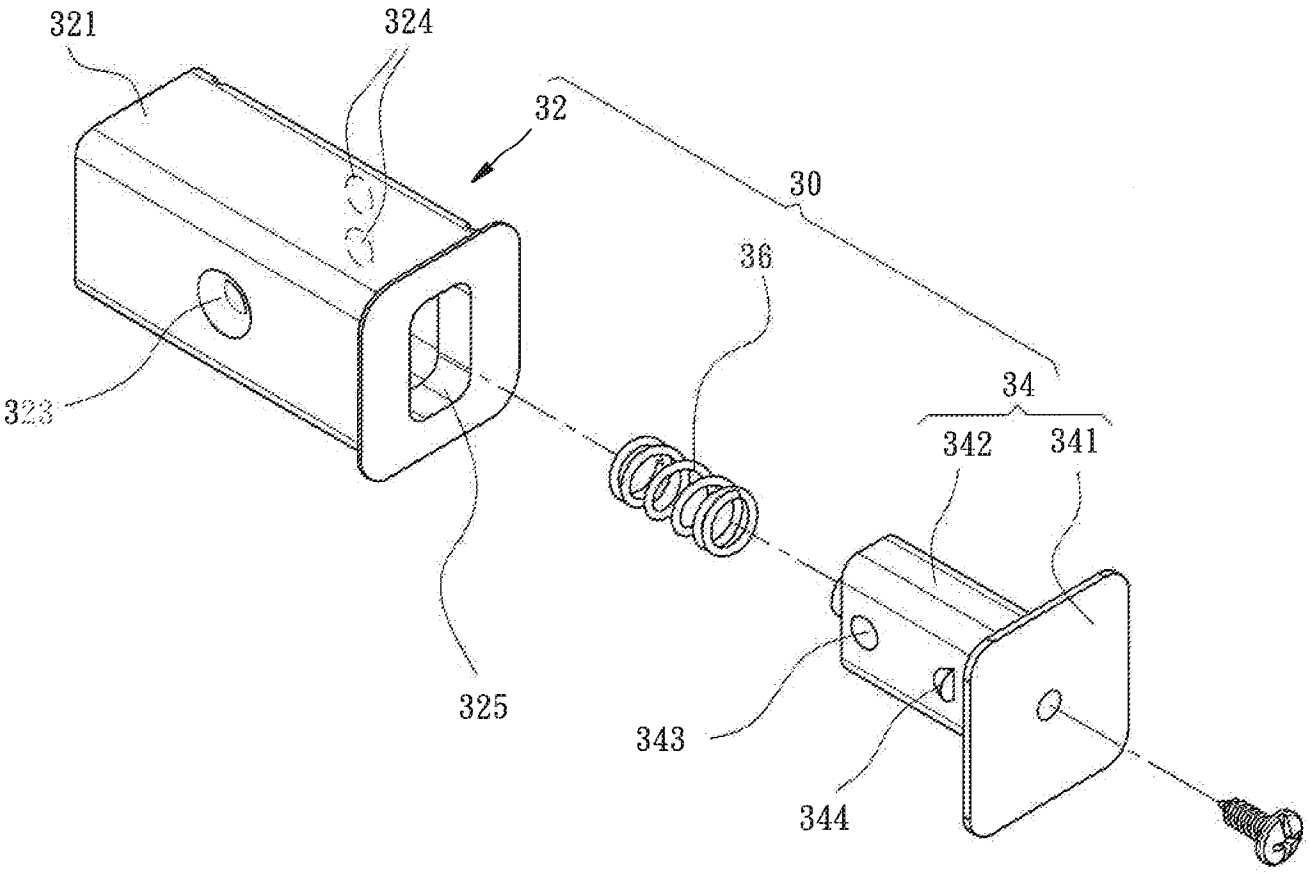
FIG. 3 is an exploded view of a controlling assembly of the first embodiment of the present invention.
Figure 5:
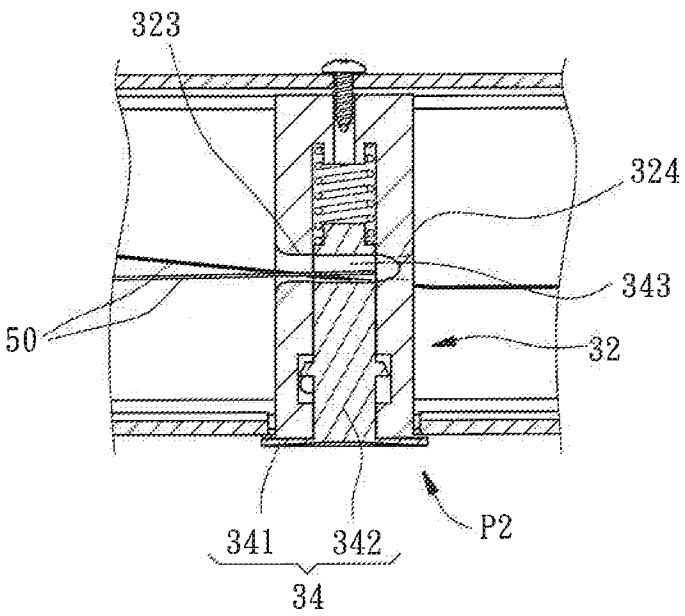
FIG. 5, similar to FIG. 4, showing the controlling member located at a released position.
Figure 4:
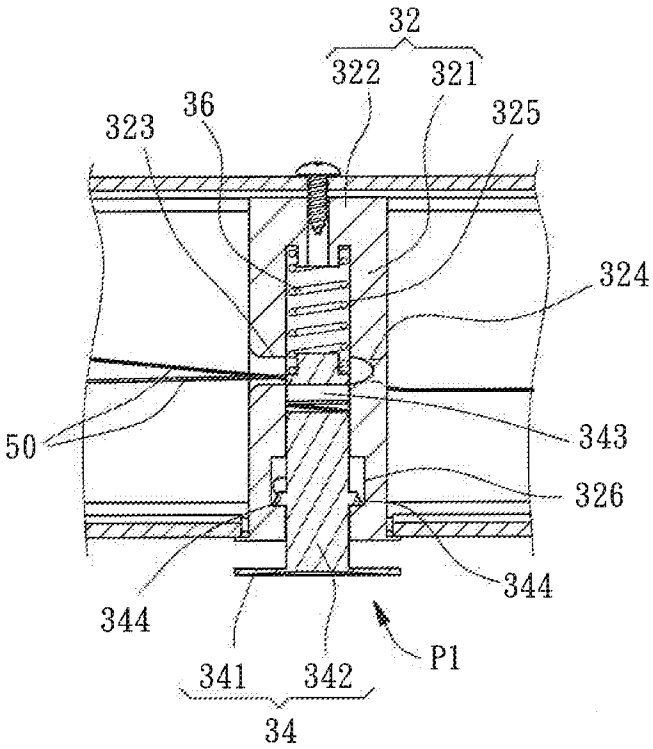
FIG. 4 is a cross-sectional view of the controlling assembly of the first embodiment of the present invention, showing the controlling member located at a retained position.

As shown in FIG. 3 through FIG. 5, each said controlling assembly 30 has a fastening seat 32 and a controlling member 34. The fastening seat 32 has a peripheral wall 321 and an end wall 322. In the present embodiment, the peripheral wall 321 has two opposite laterals, one having a first rope hole 323 and the other having two second rope holes 324. The end wall 322 is connected to one end of the peripheral wall 321 such that an accommodating socket 325 is formed between it and the peripheral wall 321 and communicates the first and second rope holes 323, 324. The controlling member 34 has a head 341 and a trunk 342. The trunk 342 is extended outward from one side of the head 341 and is for being inserted into the accommodating socket 325 of the fastening seat 32. Additionally, the trunk 342 is formed with a rope channel 343 passing therethrough. Thereby, when the controlling member 34 is at a retained position P1, the rope channel 343 of the controlling member 34 and the first and second rope holes 323, 324 of the fastening seat 32 are staggered, and when the controlling member 34 is at a released position P2, the rope channel 343 of the controlling member 34 and the first and second rope holes 323, 324 of the fastening seat 32 come to mutual communication. Moreover, the controlling assembly 30 further has a returning elastic member 36. The returning elastic member 36 props between the end wall 322 of the fastening seat 32 and an end of the trunk 342 of the controlling member 34, for normally using its resilience to bias the controlling member 34 toward the retained position P1. Referring to FIG. 3 and FIG. 4, the fastening seat 32, at inner side of the peripheral wall 321, has a retaining notch 326, while two outer lateral of the trunk 342 of the controlling member 34 are each provided with a retaining salient 344. With the engagement between the retaining salients 344 of the trunk 342 of the controlling member 34 and the retaining notch 326 of the peripheral wall 321 of the fastening seat 32, the controlling member 34 is prevented from leaving the accommodating socket 325 of the fastening seat 32 when receiving the resilience of the returning elastic member 36.

Figure 6:
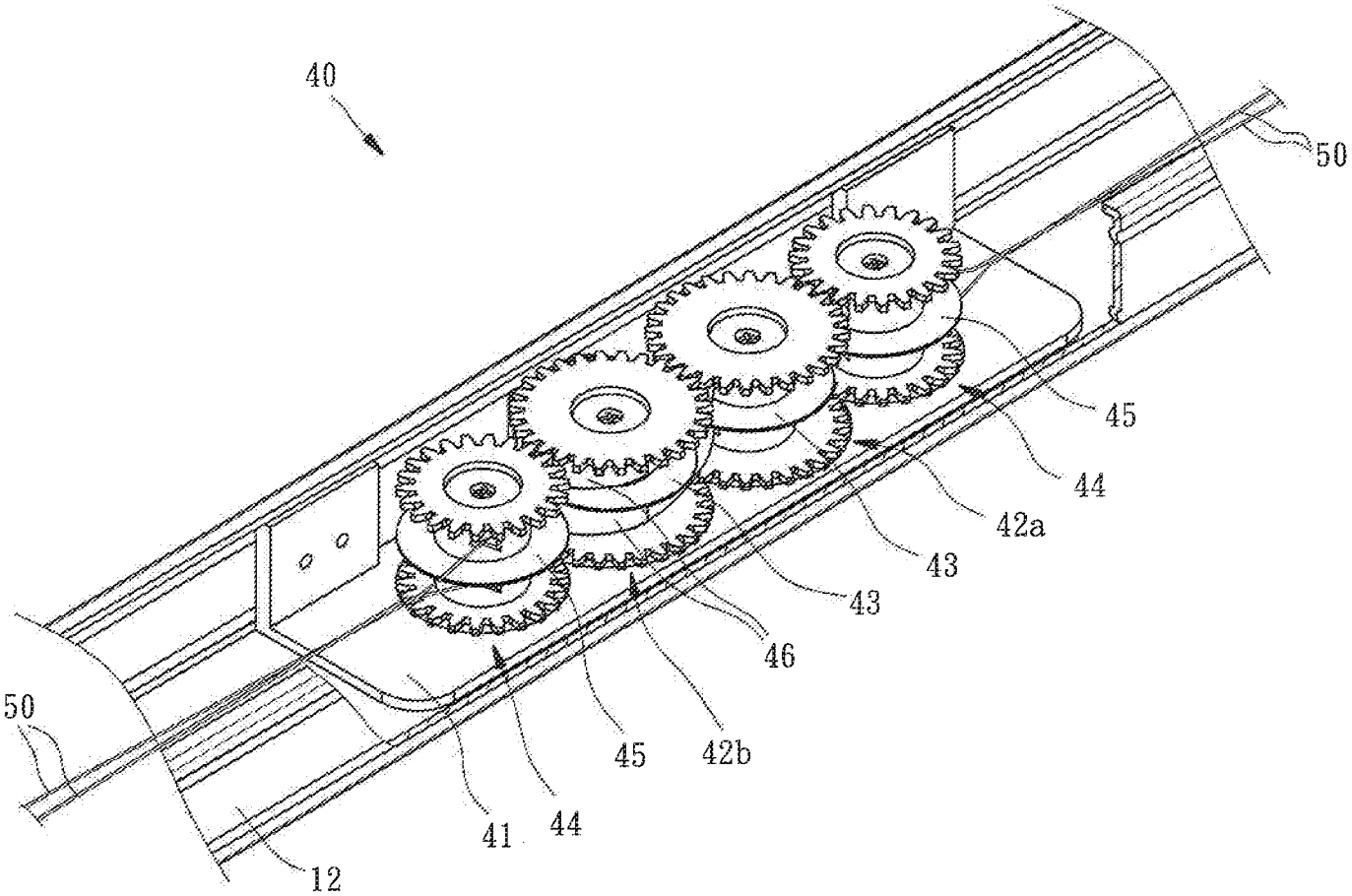
FIG. 6 is a perspective view of a gear assembly of the first embodiment of the present invention.
Figure 7:
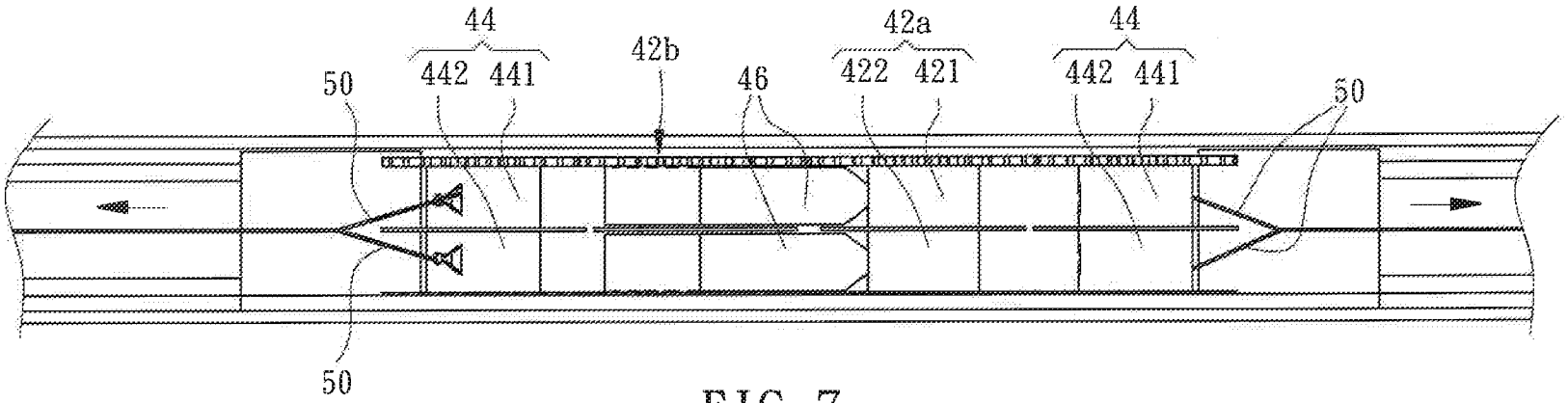
FIG. 7 is a front view of the gear assembly of the first embodiment of the present invention, showing transmission ropes being released.

As shown in FIGS. 2, 6 and 7, the gear assembly 40 is deposited between the two controlling assemblies 30 and has a gear seat 41, two driving gears 42, two first spacing rings 43, two driven gears 44, two second spacing rings 45, and two coil springs 46. The gear seat 41 is fixed in the lower beam 12. The two driving gears 42*a*, 42*b* are rotatably installed on the gear seat 41 and engaged with each other. Each of the first spacing rings 43 is fixed at a middle height of its corresponding driving gear 42 so that each of the driving gears 42*a*, 42*b* is divided into an upper half 421 and a lower half 422. The two driven gears 44 are rotatably installed on the gear seat 41 and each of which are engaged with a driving gear 42*a* or 42*b*. Each of the second spacing ring 45 is fixed at a middle height of its corresponding driven gear 44 so that each of the driven gears 44 is divided into an upper half 441 and a lower half 442. One of the coil springs 46 is connected between the upper halves 421 of the two driving gears 42*a*, 42*b* and selectably wound around the upper half 421 of one of the driving gears 42*a*, 42*b*. The other coil spring 46 is connected between the lower halves 422 of the two driving gears 42*a*, 42*b* and selectably wound around the lower half 422 of one of the driving gears 42*a*, 42*b*.

As shown in FIGS. 2, 5, 6 and 7, in each said pair of transmission ropes 50, the transmission ropes 50 each have one of their two ends fixed to the upper half 441 and the lower half 442 of the adjacent driven gear 44, respectively. The one-end-fixed transmission ropes 50 are routed through the second rope holes 324 of the fastening seat 32 of the controlling assembly 30, respectively, and then jointly pass through the rope channel 343 of the controlling member 34 and the first rope hole 323 of the fastening seat 32. Afterward, the transmission ropes 50 go out of the lower beam 12 and go up along front and rear sides of the blind body 13, respectively, to be finally fixed in the upper beam 11. Thereby, when the controlling member 34 is at the retained position P1, the stagger between the first and second rope holes 323, 324 of the fastening seat 32 and the rope channel 343 of the controlling member 34 makes the transmission ropes 50 have interference with the controlling member 34. When the controlling member 34 is at the released position P2, the communication between the first and second rope holes 323, 324 of the fastening seat 32 and the rope channel 343 of the controlling member 34 disengages the transmission ropes 50 from the interference with the controlling member 34.

Figure 8:
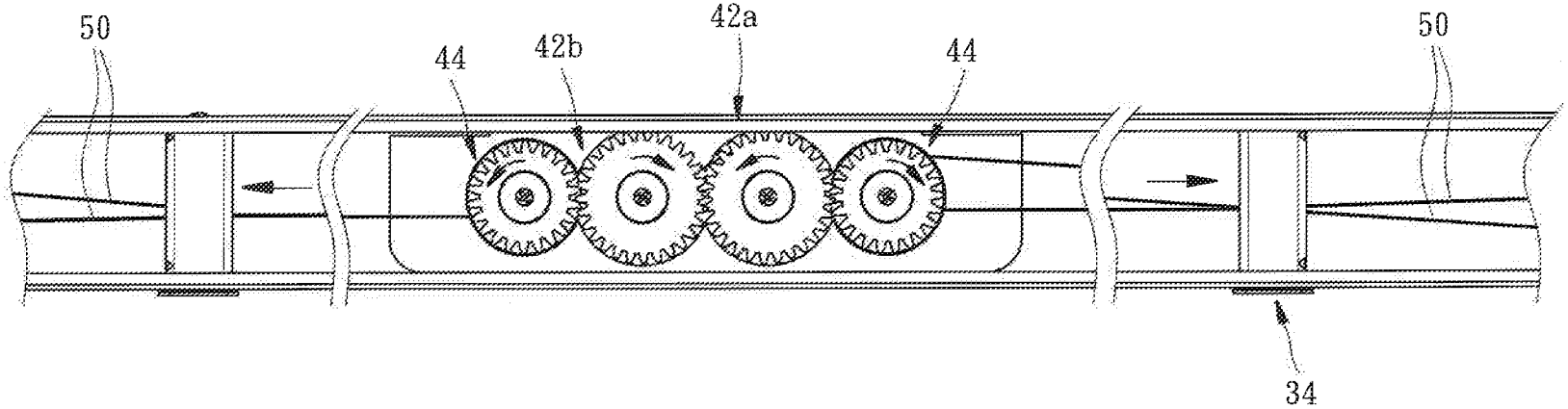
FIG. 8 is a top view of the first embodiment of the present invention, showing the transmission ropes being released.

To lower the blind body 13, the first step is to push the two controlling members 34 simultaneously to the released position P2, as shown in FIG. 5. As a second step, the lower beam 12 is manually pulled so as to gradually lower the blind body 13. In the process of lowering the blind body 13, one said driving gear 42*b* rolls up the two coil springs 46 and allows the two coil springs 46 to store resilient force, while simultaneously driving the other driving gear 42*a* to rotate, as shown in FIGS. 7 and 8. Then the two driving gears 42*a*, 42*b* drive the driven gears 44 with which they are engaged, respectively, making the two driven gears 44 rotate and release the transmission ropes 50 connected thereto. When the blind body 13 is fully lowered, the pulling force a user exerts on the lower beam 12 is removed, and simultaneously the pushing force acting on the two controlling members 34 is dismissed, so the two controlling members 34 are returned to the retained position P1 as shown in FIG. 4 by the returning elastic member 36. At this time, the stagger between the first and second rope holes 323, 324 of the fastening seat 32 and the rope channel 343 of the controlling member 34 stops the transmission ropes 50 from being released anymore. Consequently, the two driving gears 42*a*, 42*b* and the two driven gears 44 stop rotating immediately, and this makes the blind body 13 stay at the lowered state, as shown in FIG. 1.

Figure 9:
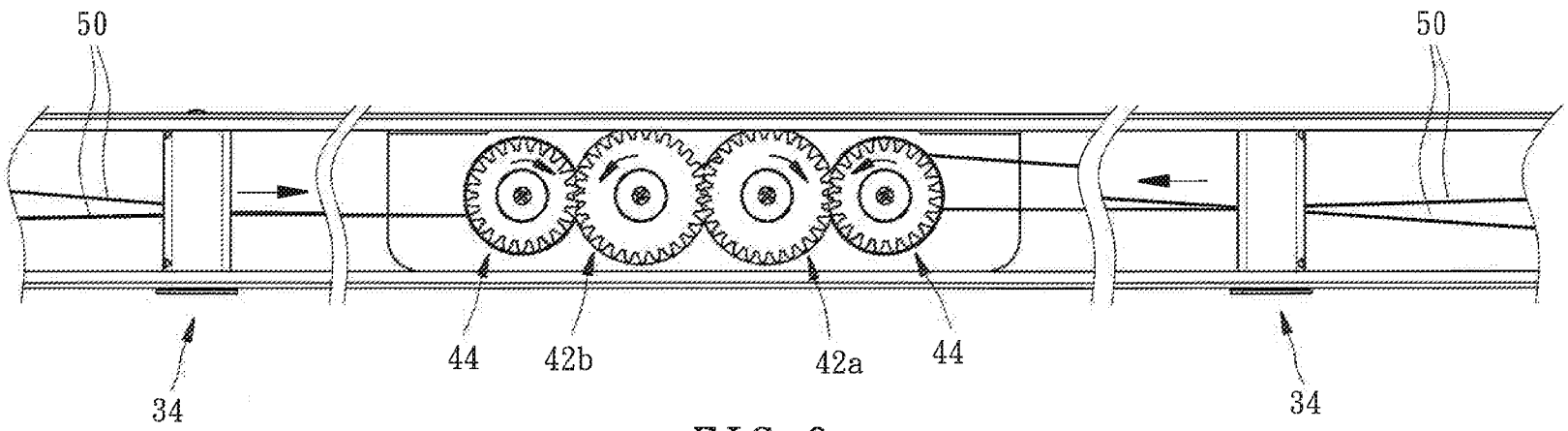
FIG. 9, similar to FIG. 8, shows the transmission ropes being rolled up.
Figure 10:
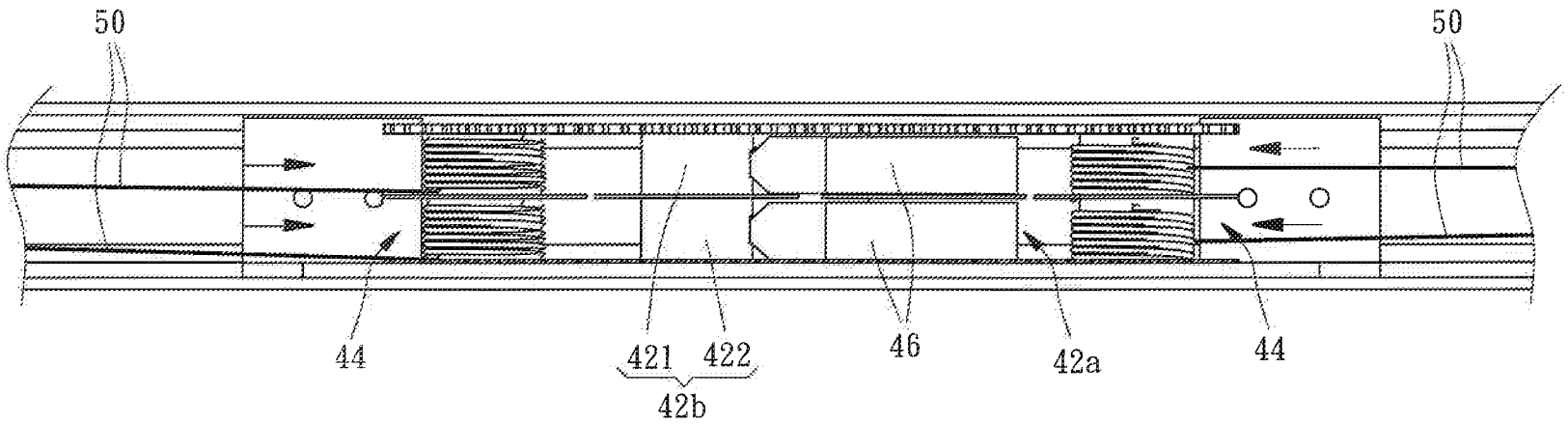
FIG. 10, similar to FIG. 7, shows the transmission ropes being rolled up.
Figure 11:
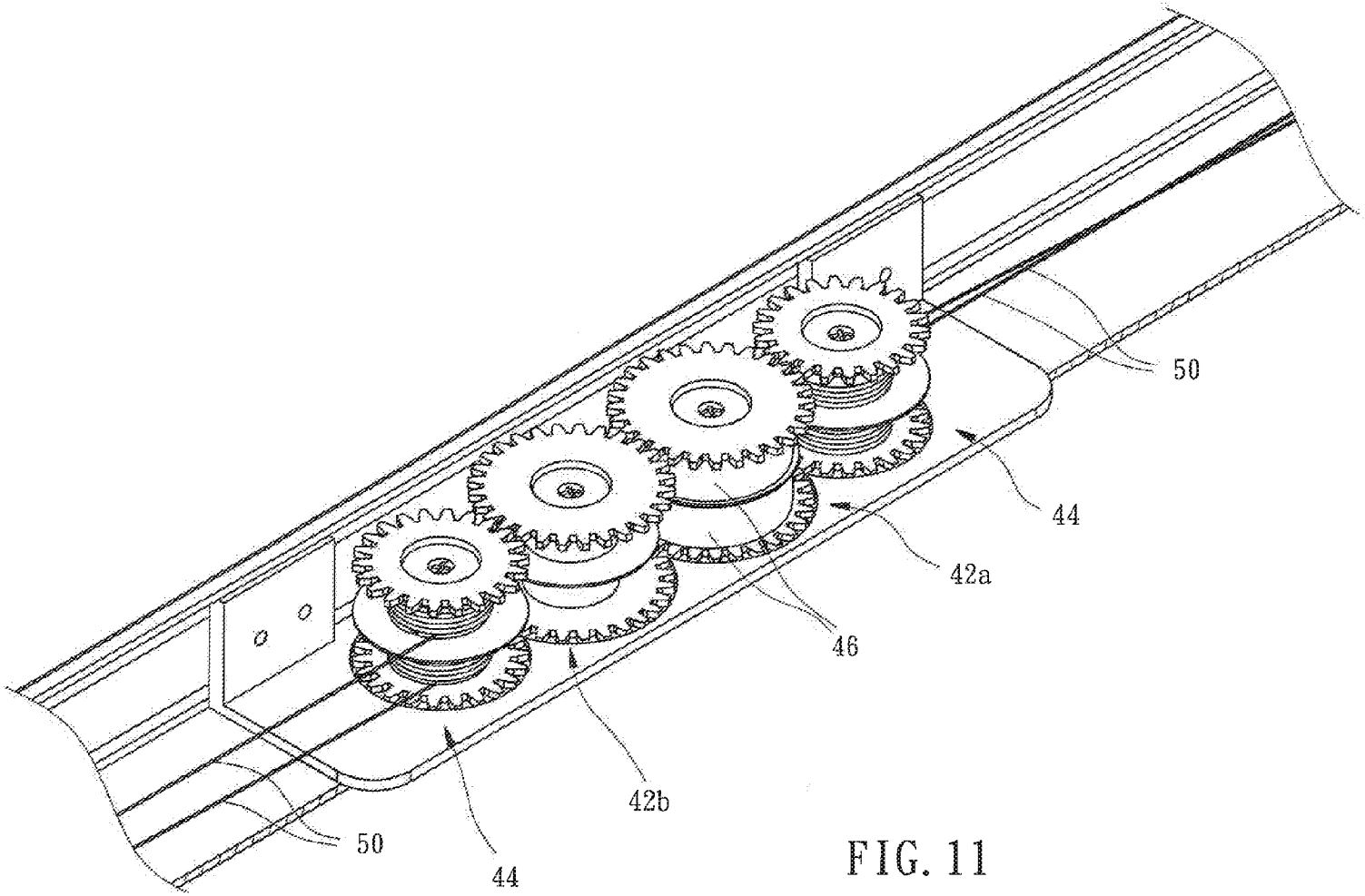
FIG. 11, similar to FIG. 6, shows the transmission ropes rolled up to the end.
Figure 12:
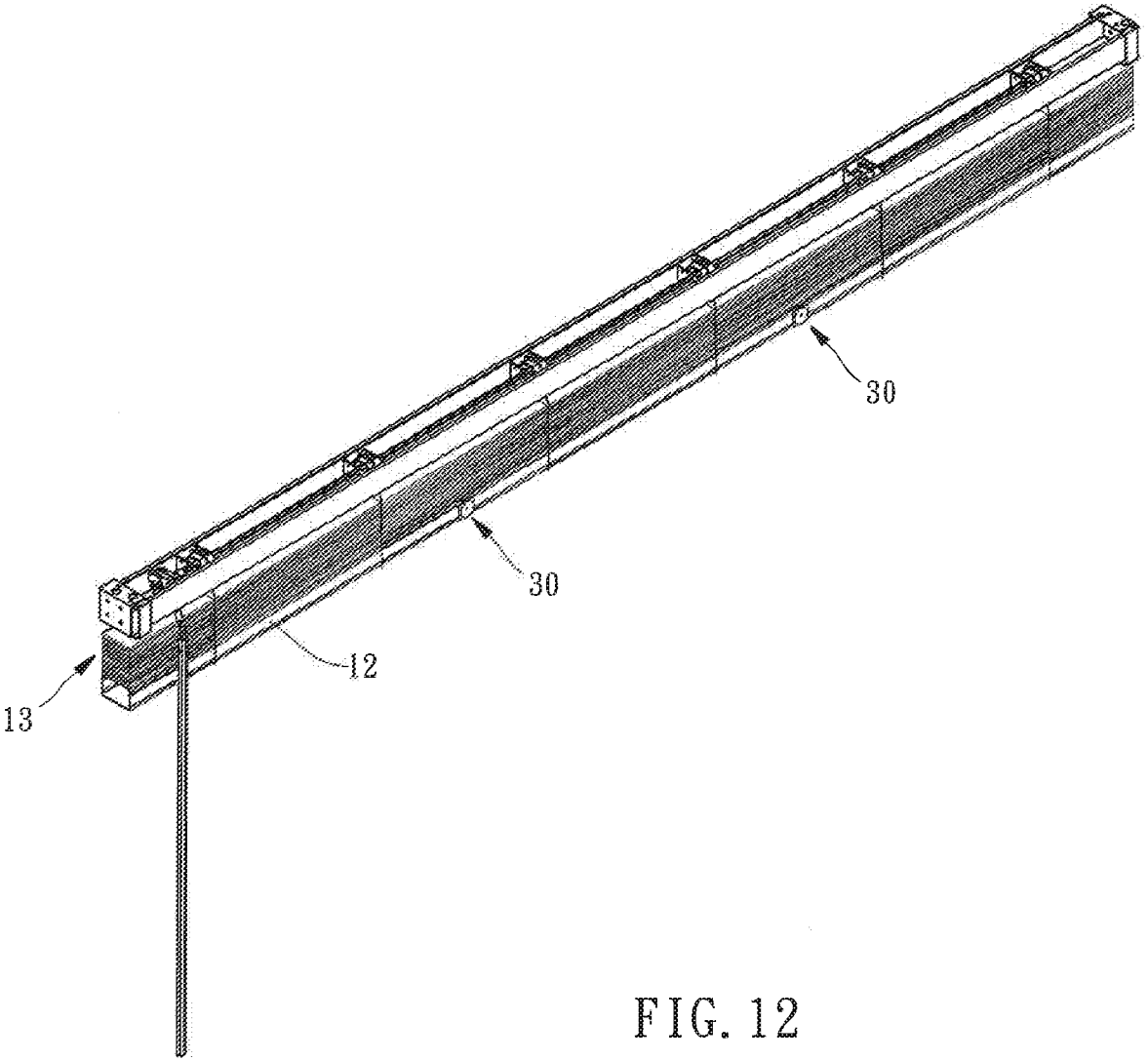
FIG. 12 is another perspective view of the first embodiment of the present invention, showing the blind body fully raised.
Figure 13:
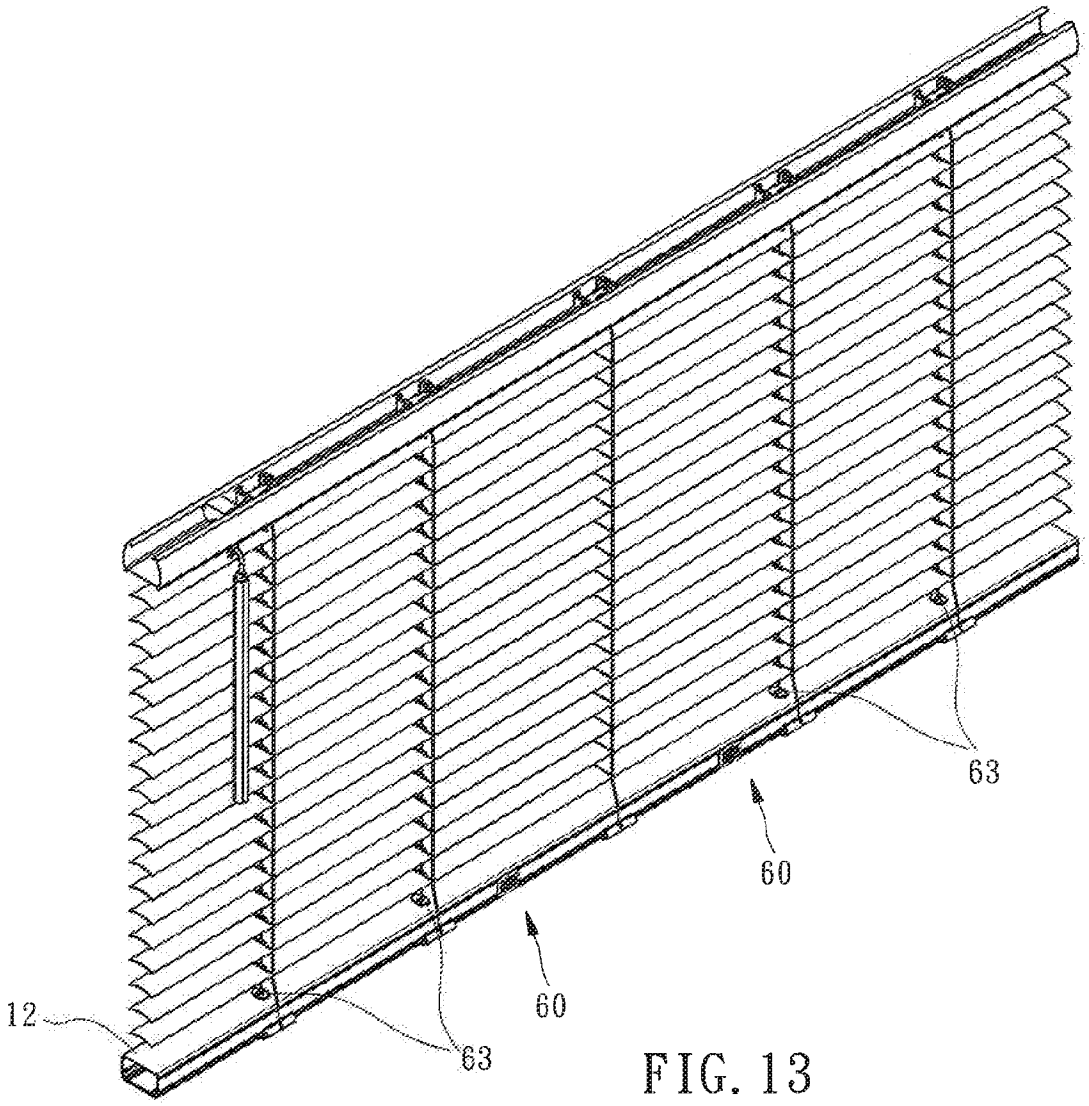
FIG. 13 is a perspective view of a cordless blind set with a second embodiment of the present invention.
Figure 14:
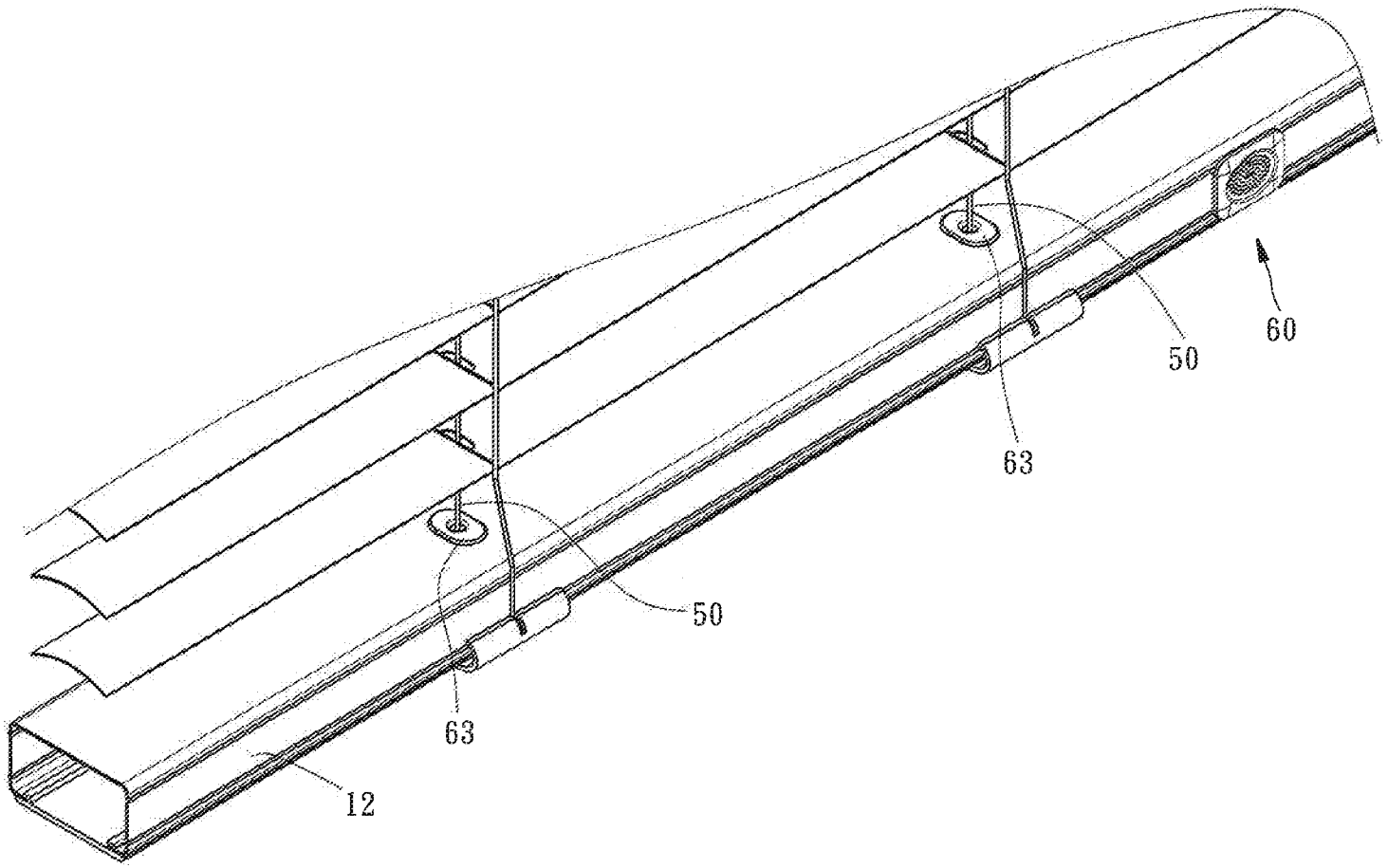
FIG. 14 is a partial, enlarged view of FIG. 13.
Figure 15:
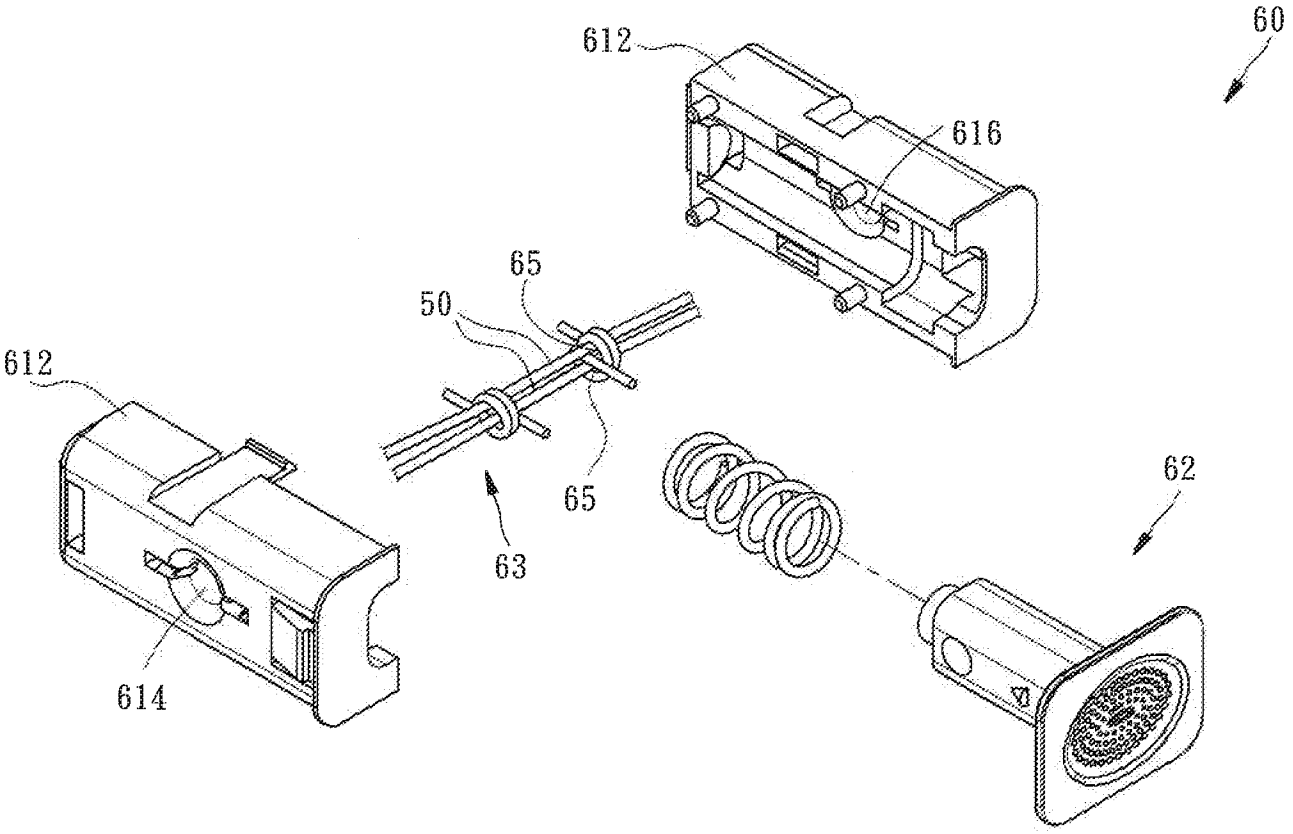
FIG. 15 is an exploded view of a controlling assembly of the second embodiment of the present invention.
Figure 16:
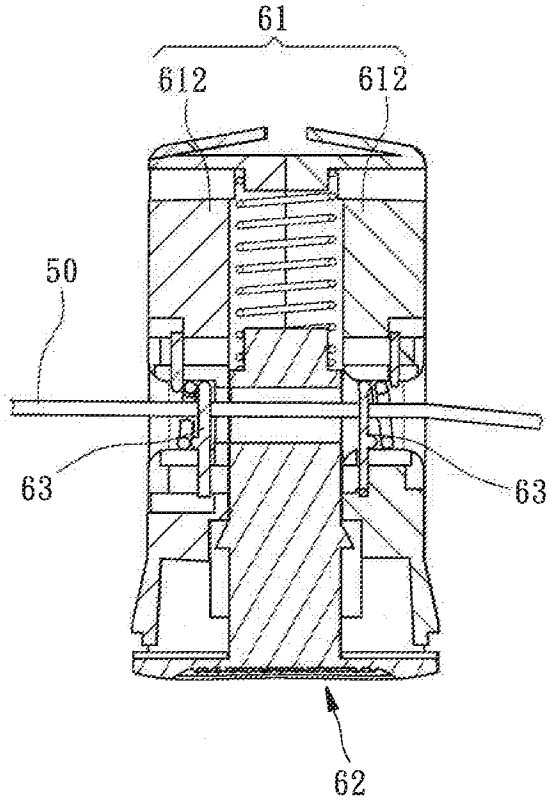
FIG. 16 is a cross-sectional view of the controlling assembly of the second embodiment of the present invention.

To raise the blind body 13, the first step is to push the two controlling members 34 simultaneously to the released position P2 as shown in FIG. 5, so that one said driving gear 42*a* receives the resilient three from the two coil springs 46 and drives the other driving gear 42*b* to rotate reversely. As a result, the two driving gears 42*a*, 42*b* drive the driven gear 44 they are engaged with to rotate reversely. In the process the two driven gears 44 rotate reversely, they roll up the transmission ropes 50 connected therewith, as shown in FIGS. 9 and 10. At this time, the user can raise the blind body 13 by applying upward pushing force to the lower beam 12. When the blind body 13 is raised to a desired level, the user can remove the pushing force applied to the lower beam 12 and simultaneously dismiss the force exerted on the two controlling members 34, so the two controlling members 34 are returned to the retained position P1 as shown in FIG. 4 by the returning elastic member 36. Now, the stagger between the first and second rope holes 323, 324 of the fastening seat 32 and the rope channel 343 of the controlling member 34 stops the transmission ropes 50 from being rolled up by the driven gear 44 anymore, as shown in FIG. 11. Consequently, the two driving gears 42*a*, 42*b* and the two driven gears 44 stop rotating immediately, thereby making the blind body 13 stay at the raised state, as shown in FIG. 12.

It is to be noted that the number of the coil springs 46 is not limited to two. In fact, at least one coil spring 46 provided between the two driving gears 42*a*, 42*b* works for the stated purpose, and in this case the use of the first spacing rings 43 can be eliminated. However, the use of two coil springs 46 helps to provide better driving force to the two driving gears 42*a*, 42*b*, and is therefore deemed as the best mode. Similarly, the number of the transmission ropes 50 is not limited to two pairs. As long as at least one transmission rope 50 is connected to each of the driven gear 44, it is acceptable and in this case the use of the second spacing rings 45 can be eliminated. However, the use of two pairs of transmission ropes 50 provides better balance and stability in the process the blind body 13 is lowered or raised, and is therefore deemed as the best mode.

Thereby, featuring the hole allocation between the fastening seat 32 and the controlling member 34, and the engagement of the plural gears 42*a*, 42*b*, 44, as well as the pulling force generated by the transmission ropes 50 and the resilient force coming from the coil springs 46, the disclosed controlling mechanism 20 can effectively control the lowering and raising of the blind body 13, in turn achieving the Objectives of convenient operation, excellent transmission and high user safety.

Furthermore, the disclosed controlling assembly may be configured in different ways. For example, FIGS. 13 through 16 reflect a controlling assembly 60 according to a second embodiment of the present invention. Therein, a fastening seat 61 is composed of two lateral caps 612 combined in a face-to-face manner. One of the lateral caps 612 has a first rope hole 614, while the other lateral cap 612 has a second rope hole 616. The first and second rope holes 614, 616 are simultaneously passed through by two transmission ropes 50. The controlling assembly 60 further has four rope-guiding rings 63 and four rope-routing members 64. The rope-guiding rings 63 are fixed to a top surface of the lower 12 and each passed through by a transmission rope 50, so as to help increase the moving smoothness of the transmission ropes 50. In addition, these rope-routing members 64 are paired when installed between the two lateral caps 612 of the fastening seat 61, so that they are aligned across the controlling member 62. Each of the rope-routing members 64 has two spaced rope-routing holes 65, each for a transmission rope 50 to pass therethrough, thereby preventing the two transmission ropes 50 from entwining during the mechanism's operation.

Figure 17:
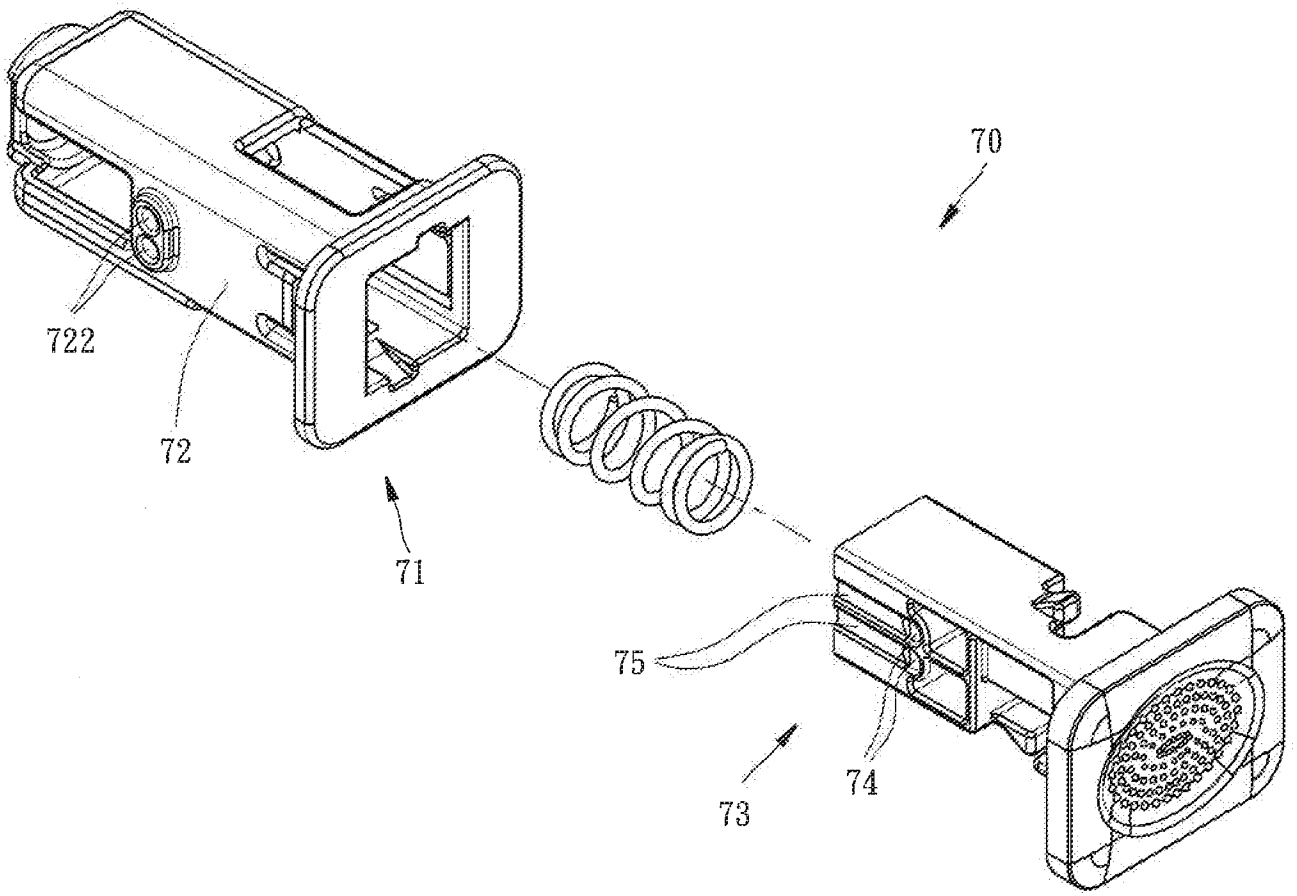
FIG. 17 is an exploded view of a controlling assembly of a third embodiment of the present invention.
Figure 18:
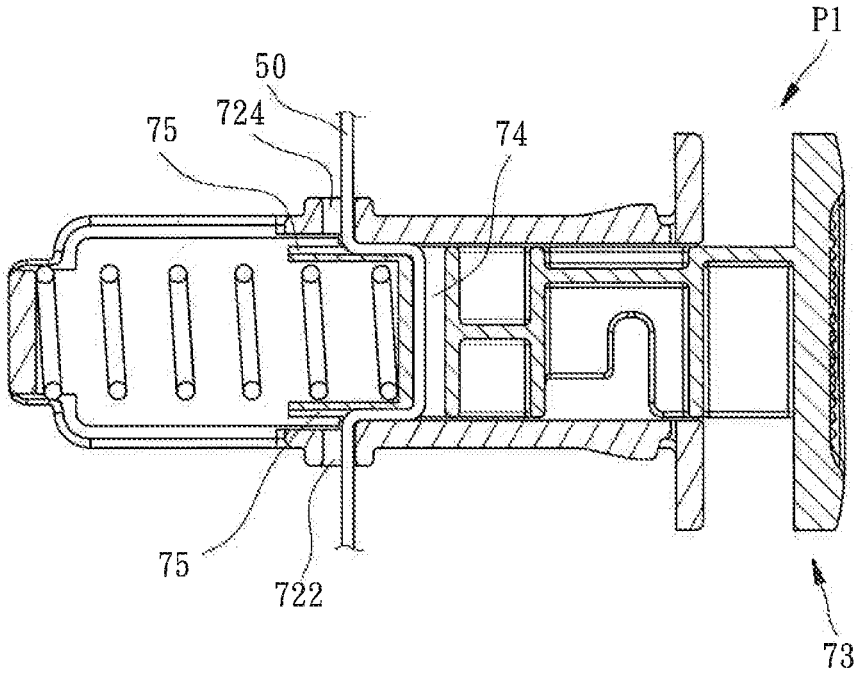
FIG. 18 is a cross-sectional view of the controlling assembly of the third embodiment of the present invention, showing the controlling member located at a retained position.
Figure 19:
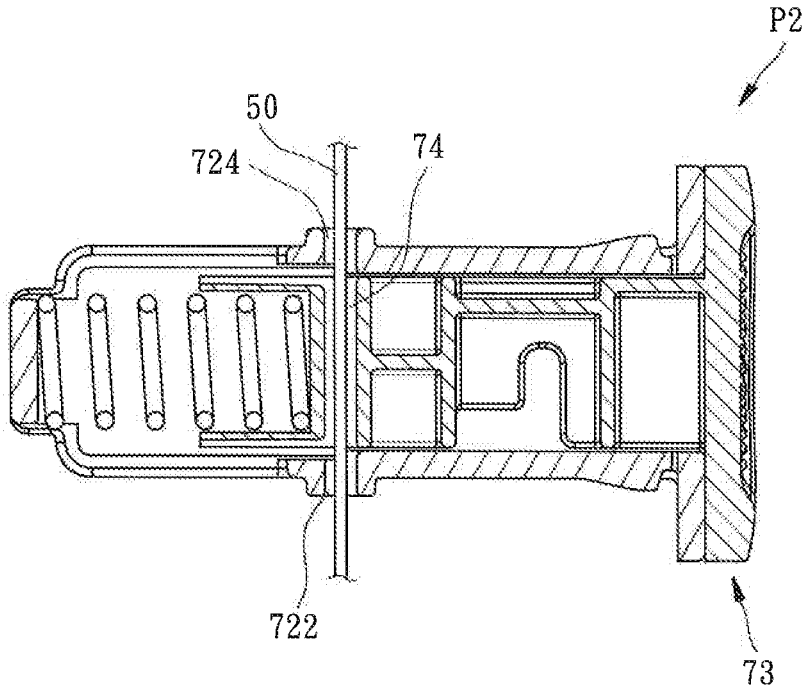
FIG. 19, similar to FIG. 18, shows the controlling member located at a released position.

Now please refer to FIGS. 17 through 19 for a controlling assembly 70 according to a third embodiment of the present invention. The controlling assembly 70 has a fastening seat 71 roughly similar to that described in the first embodiment with the difference that two first rope holes 722 are provided on the side of the peripheral wall 72 of the fastening seat 71 back on to the gear assembly 40. Each of the first rope holes 722 is for a said transmission rope 50 to pass therethrough. The peripheral wall 72 of the fastening seat 71 on its side face the gear assembly 40 has two second rope holes 724, each for a said transmission rope 50 to pass therethrough. Additionally, each said controlling member 73 has its two lateral sides formed with two rope channels 74, each for receiving a said transmission rope 50. Moreover, each said controlling member 73 has its two lateral sides formed with two receiving grooves 75 that are mutually parallel. The receiving grooves 75 each have one end connected to the corresponding rope channel 74. Thereby, when the controlling member 73 is at the retained position P1, as shown in FIG. 18, the rope channel 74 of the controlling member 73 and the first and second rope holes 722, 724 of the fastening seat 71 are staggered. At this time, two of the receiving grooves 75 of the controlling member 73 are connected to the first rope holes 722 of the fastening seat 71, respectively, and the other two receiving grooves 75 of the controlling member 73 are connected to the second rope holes 724 of the fastening seat 71, respectively. Consequently, the transmission ropes 50 are received in the receiving grooves 75 and come into mutual interference with the controlling member 73, thereby preventing the transmission ropes 50 from being rolled up or released by the corresponding driven gear 44, and in turn making the blind body 13 positioned. Also, as shown in FIG. 19, when the controlling member 73 is at the released position P2, the rope channels 75 of the controlling member 73 are communicated with the first and second rope holes 722, 724 of the fastening seat 71, so that the transmission ropes 50 are allowed to be rolled up or released by the corresponding driven gear 44, and in turn making the lowering and raising of the blind body 13 possible.

Figure 20:
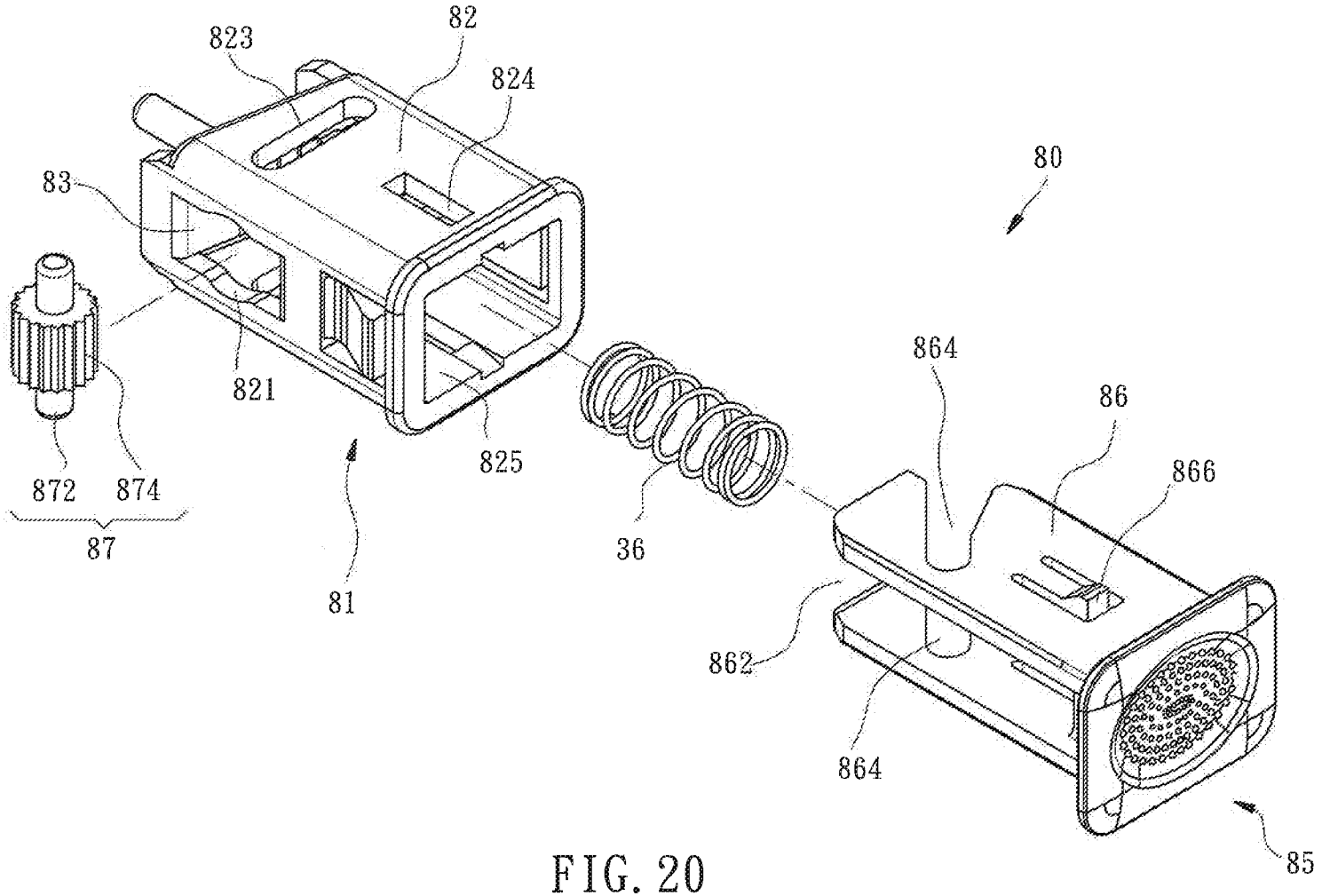
FIG. 20 is an exploded view of a controlling assembly of a fourth embodiment of the present invention.
Figure 21:
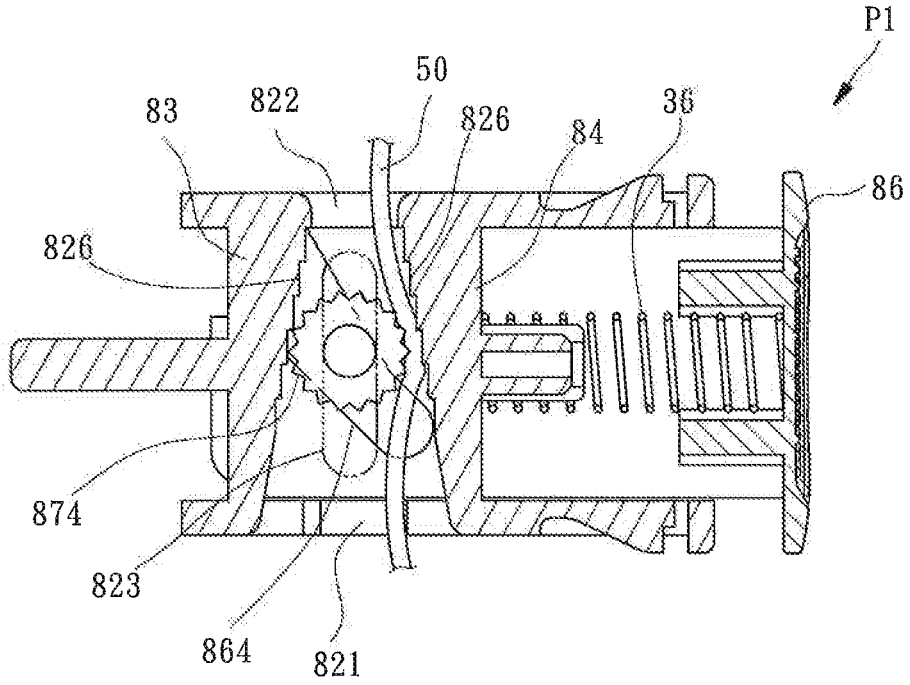
FIG. 21 is a cross-sectional view of the controlling assembly of the fourth embodiment of the present invention, showing the controlling member located at a retained position.
Figure 22:
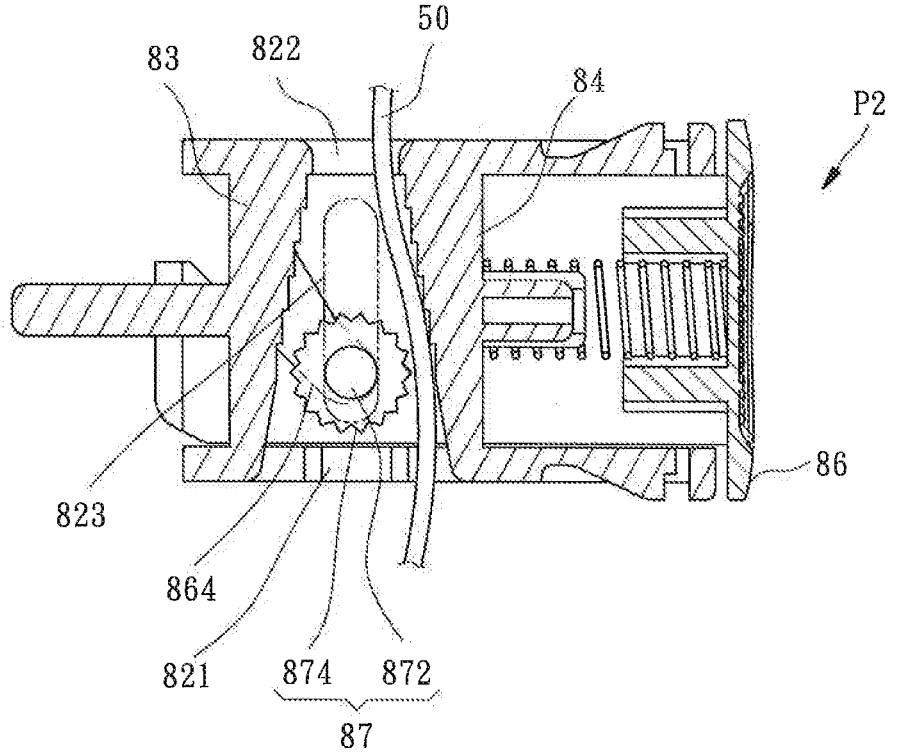
FIG. 22, similar to FIG. 21, shows the controlling member located at a released position.

Now referring to FIGS. 20 through 22, in a fourth embodiment of the present invention, a controlling assembly 80 has a fastening seat 81 and a controlling member 85.

The fastening seat 81 has a peripheral wall 82, an end wall 83, and a partition 84. The peripheral wall 82 at its side back on to the gear assembly 40 has a first rope hole 821, and at its side facing the gear assembly 40 has a second rope hole 822. The first and second rope holes 821, 822 are passed by two transmission ropes 50. The peripheral wall 82 has its top and bottom surfaces each formed with a guiding groove 823 and an engaging dent 824. The end wall 83 is connected to one end of the peripheral wall 82 so that an accommodating socket 825 is formed between it and the peripheral wall 82 and communicated with the first and second rope hole 821, 822 and the guiding grooves 823. The partition 84 is connected to the middle part of the peripheral wall 82 and its distance from the end wall 83 increasingly decreases from the first rope hole 821 to the second rope hole 822. In addition, the inner side of the end wall 83 of the fastening seat 81 and the inner side of the partition 84 of the fastening seat 81 each include a toothed portion 826.

The controlling member 85 in the present embodiment is not a single piece, but a combination of a push button 86 and a clamping gear 87. A returning elastic member 36 is provided between the end of the push button 86 and the partition 84 of the fastening seat 81. The push button 86 has is two lateral surfaces each formed with a through rope channel 862. The rope channels 862 are communicated with the first and second rope holes 821, 822 and are for two transmission ropes 50 to pass therethrough. The push button 86 has its top and bottom surfaces each formed with a chute 864 that is communicated with one of the guiding grooves 823 of the fastening seat 81. Moreover, the push button 86 has its top and bottom surfaces each having a resilient buckle 866. The engagement between the resilient buckles 866 of the push button 86 and the engaging dents 824 of the fastening seat 81 prevents the push button 86 from leaving the accommodating socket 825 when receiving the resilience acting thereon by the returning elastic member 36. The clamping gear 87 has an axle 872 and a gear body 874 connected to the axle 872. The axle 872 has its two ends inlaid into the guiding groove 823 of the fastening seat 81 and the chute 864 of the push button 86, respectively. The gear body 874 is located between the toothed portion 826 of the end wall 83 of the fastening seat 81 and the toothed portion 826 of the partition 84 of the fastening seat 81.

Thereby, when the push button 86 of the controlling member 85 is pushed to the released position P2, as shown in FIG. 22, the chute 864 of the push button 86 in turn pushes the axle 872 of the clamping gear 87 and makes the clamping gear 87 to move along the guiding groove 823 of the fastening seat 81 toward the first rope hole 821 of the fastening seat 81. Since the distance between the end wall 83 of the fastening seat 81 and the partition 84 gradually increases from the second rope hole 822 toward the first rope hole 821, the gear body 874 of the clamping gear 87 can finally release the transmission ropes 50, so that the transmission rope 50 can be rolled up or released by the driven gear 44, thereby allowing the blind body 13 to be lowered or raised. On the other hand, when the force exerted on the push button 86 of the controlling member 85 is dismissed, as shown in FIG. 21, the push button 86 is returned to the retained position P1 by the returning elastic member 36, so that the clamping gear 87 is pushed by the chute 864 of the push button 86 and moves toward the second rope hole 822 of the fastening seat 81. Since the distance between the end wall 83 of the fastening seat 81 and the partition 84 gradually decreases from the first rope hole 821 toward the second rope hole 822, once the gear body 874 of the clamping gear 87 gets engaged with the toothed portion 826 of the end wall 83 of the fastening seat 81 and with the toothed portion 826 of the partition 84 of the fastening seat 81, the transmission ropes 50 are simultaneously fixed between the gear body 874 of the clamping gear 87 and the toothed portion 826 of the partition 84 of the fastening seat 81. At this time, the transmission ropes 50 are prevented from being rolled up or released by the driven gear 44, so as to make the blind body 13 positioned.

What is claimed is:

1. A controlling mechanism for a cordless blind set, the cordless blind set having an upper beam, a lower beam, and a blind body formed between the upper and lower beams, and the controlling mechanism comprising:

two controlling assemblies, each having a fastening seat, a controlling member, and a returning elastic member; the fastening seat being deposited on the lower beam and having at least one first rope hole, at least one second rope hole opposite to the first rope hole, and an accommodating socket communicated between the first and second rope holes; the controlling member being such received in the accommodating socket of the fastening seat that it is movable between a retained position and a released position and having at least one rope channel; the returning elastic member being provided between the fastening seat and the controlling member, for normally holding the controlling member at the retained position;

a gear assembly, being located between the two controlling assemblies and having a gear seat, two driving gears, two driven gears, and at least one coil spring; the gear seat being fixed in the lower beam; the two driving gears being rotatably fixed to the gear seat and engaged with each other; the two driven gears being rotatably fixed to the gear seat and engaged with one said driving gear, respectively; the coil spring being connected to the two driving gears and selectably wound around one of the two driving gears; and at least two transmission ropes, passing through the first and second rope holes of one said fastening seat and the rope channel of one said controlling member; each said transmission rope having one end fixed to the upper beam and having an opposite end fixed to one said driven gear of the gear assembly;

wherein, when the controlling member is at the retained position, it comes into interference with the transmission ropes, so that the driven gear is unable to roll up or release the transmission ropes, and when the controlling member is at the released position, the transmission ropes are released, so that the driven gear is able to roll up or release the transmission ropes;

wherein the fastening seat of each said controlling assembly has a peripheral wall, an end wall, and a partition; the peripheral wall at its side back on to the gear assembly having one said first rope hole for one said transmission rope to pass therethrough, and the peripheral wall at its side facing the gear assembly having one said second rope hole for one said transmission rope to pass therethrough; the peripheral wall having each of its top and bottom surfaces provided with a guiding groove communicated with the accommodating socket; the end wall being connected to one end of the peripheral wall; the partition being connected to a middle part of the peripheral wall; the controlling member having a push button and a clamping gear; the returning elastic member being provided between an end of the push button and the partition of the fastening seat; the push button having each of its two lateral sides formed with one said rope channel for one said transmission rope to pass therethrough; the push button having each of its top and bottom surfaces provide with a chute communicated with the guiding groove; the clamping gear having an axle and a gear body connected to the axle; and the axle having its two ends movably inlaid in one said guiding groove of the fastening seat and one said chute of the push button whereby when the controlling member is at the retained position, the transmission ropes are retained between the gear body of the clamping gear and the partition of the fastening seat, and when the controlling member is at the released position, the transmission ropes are allowed to pass through a space between the gear body of the clamping gear and the partition of the fastening seat.

2. The controlling mechanism of claim 1, wherein a distance between the end wall of the fastening seat and the partition gradually decreases in a direction extending from the first rope hole toward the second rope hole.

3. The controlling mechanism of claim 1, wherein each of an inner wall of the end wall of the fastening seat and an inner wall of the partition of the fastening seat has a toothed portion for working with the gear body.

4. The controlling mechanism of claim 1, wherein each of the top and bottom surfaces of the peripheral wall of each said fastening seat has an engaging dent, and each of the top and bottom surfaces of the push button of the controlling member has a resilient buckle, so that the resilient buckles are removably engaged with the engaging dents, respectively.

5. The controlling mechanism of claim 1, wherein the gear assembly further comprises two second spacing rings; each said second spacing ring being fixed to a middle height of one said driven gear so that the driven gear is divided into an upper half and a lower half; the transmission rope being provided in a number of four; and the transmission ropes being paired when passing through the first and second rope holes of one said fastening seat and the rope channel of the push button of one said controlling member, in which two said transmission ropes have their one ends fixed to the upper halves of the driven gears, respectively, and the other two said transmission ropes have their one ends fixed to the lower halves of the driven gears, respectively.

* * * * *